US007495835B2

(12) United States Patent
Daley

(10) Patent No.: US 7,495,835 B2
(45) Date of Patent: Feb. 24, 2009

(54) DISPLAY NOVELTY

(76) Inventor: Ronald Daley, 94 Hart St., Beverly, MA (US) 01915

( * ) Notice: Subject to any disclaimer, the term of this patent is extended or adjusted under 35 U.S.C. 154(b) by 28 days.

(21) Appl. No.: 11/649,151

(22) Filed: Jan. 3, 2007

(65) Prior Publication Data

US 2007/0189003 A1 Aug. 16, 2007

Related U.S. Application Data

(60) Provisional application No. 60/772,712, filed on Feb. 13, 2006.

(51) Int. Cl.
*G02B 27/14* (2006.01)

(52) U.S. Cl. ..... 359/630

(58) Field of Classification Search ..... 359/630; 345/8

See application file for complete search history.

(56) References Cited

U.S. PATENT DOCUMENTS

RE28,847 E * 6/1976 Vizenor ..... 359/631
4,398,799 A * 8/1983 Swift ..... 359/632
5,033,818 A * 7/1991 Barr ..... 359/630
6,023,253 A * 2/2000 Taniguchi et al. ..... 345/7
6,088,165 A * 7/2000 Janeczko et al. ..... 359/629
2004/0162549 A1* 8/2004 Altshuler ..... 606/9
2007/0115651 A1* 5/2007 Murphy ..... 362/103

* cited by examiner

*Primary Examiner*—Jessica T Stultz
*Assistant Examiner*—Mahidere S Sahle
(74) *Attorney, Agent, or Firm*—Joseph E. Funk

(57) ABSTRACT

There is provided a face mask with two eye holes, having a lighting display unit located inside a housing on the front of the forehead area of the mask and having a reflective, transparent sheet attached to the front of the mask between the eye holes and the housing. The reflective, transparent sheet is angled down and away from the front of the mask at an angle of about forty-five degrees. When the lighting display unit is energized two LEDs inside the housing, one above each eye hole of the mask, aim their light downward at the top front surface of the reflective, transparent sheet where it is reflected away from the front of the mask in a reverse heads up display operation. A viewer looking at the front of the mask sees what appears to be a pair of illuminated eyes in the eye holes of the mask. The light from the LEDs may be modified by electronic means or by light filters to change the appearance of the illuminated eyes. The LEDs and an angled reflective sheet may be utilized to create a display novelty that may be worn on a person, set on a table or hung on a wall.

19 Claims, 2 Drawing Sheets

DISPLAY NOVELTY

RELATED APPLICATION

This utility patent application is related to provisional patent application Ser. No. 60/772,712 filed Feb. 13, 2006 and entitled "Face Mask Lighting Display System".

FIELD OF THE INVENTION

The present invention relates to display novelty devices including pictures, pendants and novelty face masks that are mounted on a wearers face, and all the display devices implement a reverse heads up display effect. A person in front of the wearer of the mask and looking at the mask sees a visual display in the area of the eyes.

BACKGROUND OF THE INVENTION

Display pendants worn around the neck with a necklace and novelty face masks are well known in the prior art. Face masks are worn by adults and children when attending Halloween parties, masquerade parties, character role play, or for simple practical jokes or in play. They are worn whenever an individual desires a novelty disguise or appearance. The fun of wearing a novelty face mask is often in the effect it has on the viewers of the mask, their expression of surprise, shock, horror, etc.

One such face mask fits over the head of a wearer and contains batteries, an on/off switch, sound generation circuitry and a small speaker. Various sounds are generated using this arrangement. Other such face masks have light emitting diodes (LEDs) which are located as pupils within artificial or plastic eyes of the face mask which eyes, when the electrical circuit is completed, will either display constant red lights or, alternatively, the pupils can blink the red light on and off if a timer is connected in series to the light emitting diodes.

However, the face masks having LEDs located in the area of the eyes interfere with the vision of a wearer of the mask unless the LEDs located as pupils within artificial or plastic eyes of the face mask are located in one position through the face mask and holes for the wearer of the mask to see through are located in another position through the face mask. In the latter case the visual impression is lessened by having eye holes for vision by the mask wearer and different eye holes for the LEDs.

Thus, there is a need in the art for a novelty face mask where the visual effect of lit LEDs as eyes of the mask is in the same position as the holes through which the wearer sees, yet the wearer's vision is not blocked at all by the LEDs. There is also a need in the art for a display pendant that creates the effect of a light inside the body of the wearer of the pendant.

SUMMARY OF THE INVENTION

The foregoing needs in the prior art are satisfied by the present invention. A novel lighted face mask is disclosed that makes it appear to an observer of the mask on a wearer as if the wearer has red glowing eyes in the eye area of the mask but deep within the wearer's head. In addition, the glowing red eyes are in the same position that the wearer of the mask sees through. This is a very eerie visual impression on person viewing the mask being worn with the LEDs being lit. A pendant utilizes the same principle as the face mask and creates the effect of a light inside the body of the wearer of the pendant.

The LEDs are preferably red but may be any color. In addition, the LEDS may be lit steadily, but they may also be turned on and off or have their intensity varied.

To create these eerie visual effects the mask has eerie eyes painted thereon with a small hole through the center of each eye through which the mask wearer sees. The LEDs are not positioned in or close to these eye holes, yet a person viewing the mask from the front sees the lit LEDs in these eye holes. This is done with a reverse heads up display operation.

Attached to the mask just below where the eye brows are shown is a small, thin, rigid sheet of transparent plastic. The plastic angles downward and away from the front of the mask at an angle of approximately forty-five degrees to extend in front of both the eye holes. The transparent plastic does not interfere with the vision of the wearer of the mask who sees through the plastic sheet, and the plastic sheet does not unduly interfere with the visual impression of the mask when observed from the front by another person.

The forehead region of the mask extends slightly over and beyond the eyebrows. There are two holes through the bottom of the extended portion, one hole being right above each of the eye holes. Inside the face mask and in registration with each of the holes through the extended portion is a red LED. A battery power source and power switch, and possibly circuitry, are located in a container on the rear of the mask. They are connected to the LEDs in the front of the mask by wires around the inside periphery of the mask.

When a wearer of the mask turns the switch on the LEDs are energized and emit red light. The red light projects through the small holes in the bottom of the forehead extended portion. The light impinges on the front surface of the piece of transparent plastic and is reflected away from the front of the mask where it is seen by a person in front of and looking at the mask. This is a reverse heads up display effect. This causes the light reflected from the front of the transparent plastic sheet to appear to be coming from a light source inside the head of the wearer of the mask. This is very eerie visual impression to the observer of the mask. At the same time the wearer of the mask does not see the light from the LEDs. Their vision through the eye holes is not impaired.

DESCRIPTION OF THE DRAWING

The invention will be better understood upon reading the following Detailed Description in conjunction with the drawing in which.

DETAILED DESCRIPTION

Figure 1:
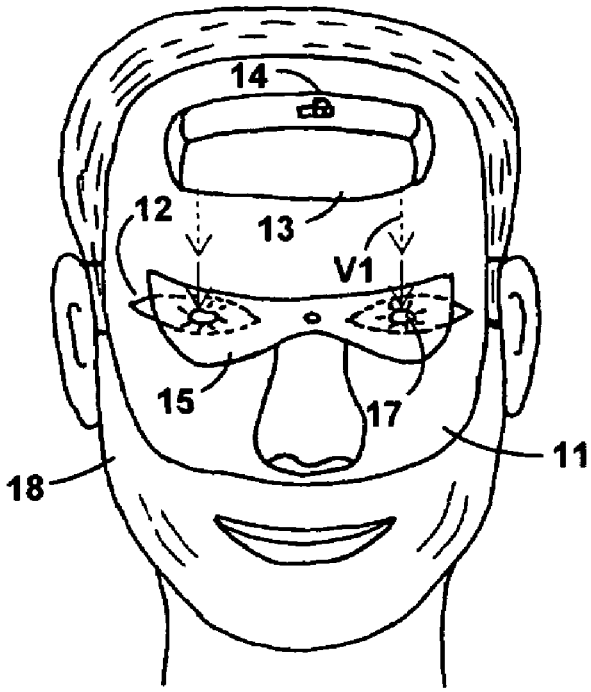
FIG. 1 is a front view of the mask showing the eyes being lit by the reflection of lit LEDs.

A front view of a novel lighted face mask 11 is shown in FIG. 1 that makes it appear as if the wearer of the mask has glowing eyes 17 within their head. Mask 11 is preferably formed of thin opaque plastic material and generally conforms to facial features. In FIG. 1 mask 11 is shown in a simple form covering only a portion of the face 18 of the mask wearer. However, mask 11 may cover the entire face 18 or the entire head of the wearer similar to a costume helmet and may have the facial appearance of a comic book character, an ogre, an animal or any other mask typically worn at Halloween, children's role play, or at a costume ball.

Figure 2:
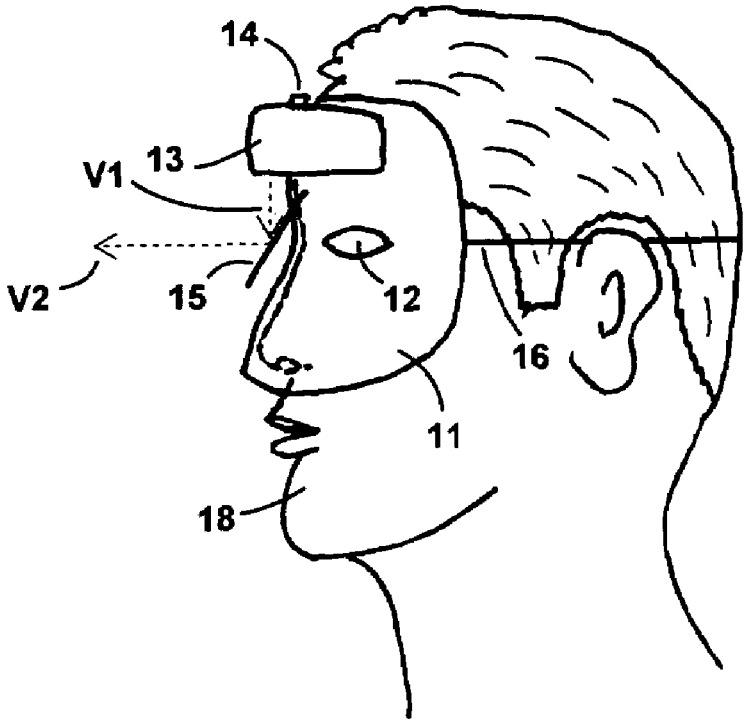
FIG. 2 is a side view of the mask showing the path of the reflected light showing how the eyes appear to be lit by the reflection of the LEDs.

Mask 11 has two eye cutouts or openings 12 through which the wearer of mask 11 actually sees while wearing the mask. The basic mask shown in FIGS. 1 and 2 is held to the face of the wearer by elastic straps 16 which are preferably adjustable. Attached to the upper, forehead area of the mask is a protruding container 13. In FIGS. 1 and 2 container 13 is shown in a simple form but may be made less conspicuous by having the appearance of a protruding forehead. Container 13 has two openings in its bottom edge (not shown), one above each of the eye openings 12 and at the tail end of arrow vectors V1 in FIGS. 1 and 2. Standard AAA batteries, or other smaller batteries, are inserted into and held in a battery holder (not shown) inside container 13. The batteries are preferably inserted into container 13 from the rear of mask 11. There are two light emitting diodes (LEDs) (not shown in FIGS. 1 and 2) mounted inside container 13, that face and emit light in a downward direction and one LED is in registration with each opening through the bottom of container 13 above each of the aforementioned eye openings 12. There is also an ON-OFF switch 14 mounted through the top surface of container 13. This switch may be mounted anywhere including being out of sight inside container 13 and accessed when the mask 11 is removed from the face 18 of the wearer. The LEDs emit light in the direction indicated by the vector arrows V1 shown in FIGS. 1 and 2. The LEDs are preferably red but may be any color. Other lighting sources may also be utilized. The LEDs may also change color and blink.

Attached to the front of mask 11 is a flat piece of clear plastic 15 having the shape shown in FIG. 1. The exact edge shape of clear plastic 15 is not important and may vary. The top edge of clear plastic piece 15 is attached to the front of mask 10 above the two eye openings 12. Clear plastic piece 15 is preferably attached to mask 11 with an adhesive but any fastening means may be utilized.

The bottom edge of flat, clear plastic piece 13 is angled away from mask 10 at approximately a 45 degree angle. When the LEDs are lit their light reflects from the front surface of flat plastic 13 in the direction of vector arrows V2, furthest from mask 11, and are seen by a person standing in front of the wearer of mask 10 and looking at the mask. These reflections are shown in FIG. 1 as bright spots 17 in eye openings 12. The wearer of mask 11 does not see the LED light, or sees it very faintly so their vision through the two eye openings 12 and plastic piece 13 is not impaired. This operation is alike a heads up display (HUD) in an aircraft, but in reverse. In typical HUD operation the light from the LEDs would hit and reflect from the rear side of flat plastic 15 and would be seen by the wearer of mask 11.

If the two LEDs are red in color a frontal observer of mask 10 sees red dots where the eyes of the wearer of mask 11 are. In addition, the red dots appear to be coming from inside the head of the mask wearer. The LEDs may be any color. Some LEDs may generate different colors depending on the voltage applied to them. While the LEDs are preferably lit steady additional circuitry may be added to blink the LEDs and/or to change their color.

In addition, a plastic or glass filter (not shown) may be placed in front of each LED inside container 11 and the light from each LED passes through the filter in front of it before reflecting from the front surface of clear plastic piece 15. The filters may be of different colors to change the color of the dots that will be seen by a person looking at the front of mask 10 when the LEDs are lit. To facilitate this change in color by a user the LEDs or other light sources would be white and the filters will change the color of the dots as viewed from the front of mask 11. To further facilitate these color changes the plastic filters may be easily attached to the bottom of container 11 over the holes 17 so they may easily be changed.

Further, patterns may be embedded in the plastic filters. For example, if the pattern on each filter is that of a serpent's eye, or a cat's eye, a viewer looking at the front of mask 10 with the LEDs energized will see what appears to be a glowing serpents eye or a cats eye looking at them. The filter can also be a liquid crystal display screen that has an image electronically displayed thereon, and the displayed image may quickly or slowly be changed to another image.

Other than a filter a lens may be positioned in front of the filter and LED to enlarge the appearance of the dots or eyes seen by someone looking at the face mask. Alternately, an image may be placed on the lens.

On the top of container 13 is an ON-OFF power switch 14. When switch 14 is placed in its ON position power is applied to the light emitting diodes and they emit light in the downward direction through the holes in the bottom edge of container 13. The circuit and batteries for applying power to the two LEDs is contained inside container 13 and is so simple it can be implemented by anyone with little skill in the electrical arts. The circuitry is shown ion and described with reference to FIG. 3.

Due to the distance of the LEDs from the front of flat plastic piece 15 a frontal observer of mask 11 sees the red dots of the LEDs as if they are sunk inside the head of the mask wearer. This is a very eerie appearance and is even more pronounced in dim ambient lighting.

The light from the LEDs may be modified by electronic means or by light filters to change the appearance of the illuminated dots in the eyes of the mask. Some LEDs change color when different operating voltages are applied to them. Simple circuitry can be added to modifying the voltage applied to the LEDs over a period of time so the color of the light emitted by the LEDs changes correspondingly. The color of the illuminated eyes may be red at one time and green a while later.

For another example, the signal from a square wave generator that is in a ONE state several times longer than in ZERO state may be applied to the LEDs to turn them on and off to make it appear that the illuminated eyes are realistically blinking. Light filters may also be added inside the protrusion in front of each of the two LEDs. Using filters the color of the illuminated eyes may be altered, or the filters may images thereon so the illuminated eyes may be changed to appear as the eye of a snake, cat or other creature.

Figure 3:
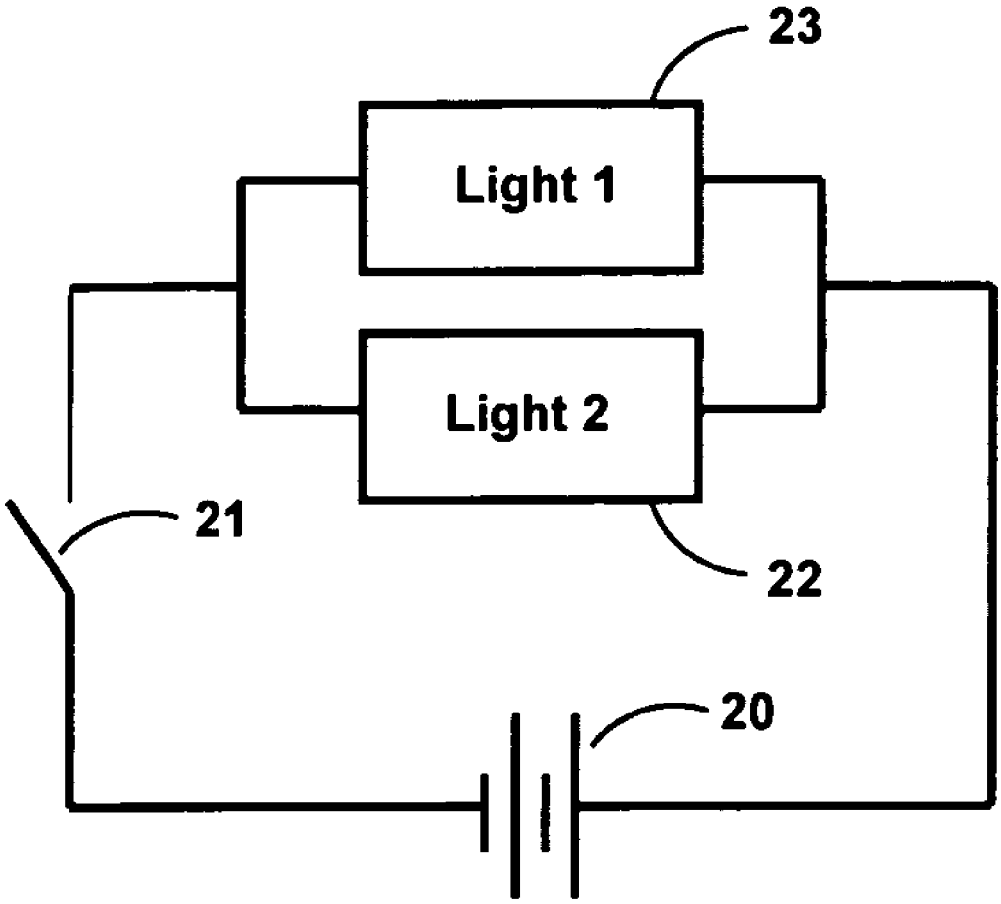
FIG. 3 is a simple schematic diagram showing how the LEDs are energized.

In FIG. 3 is shown the circuitry that is mounted inside protrusion 13. The basic circuit is simple. The two LEDs 22 and 23 are connected in parallel and they are connected in series with batteries 20 and ON-OFF switch 21. When switch 21 is operated its contacts are closed and power is applied to LEDs 22 and 23. Other electronic circuitry may be added to achieve the visual effects described in the previous paragraph.

The concept of mask 10 can also be applied to other than a face mask. If a planar version is implemented as a display novelty it may be mounted as a picture on a wall, worn on a person, or set on a table. One or more glowing dots will be seen in the display novelty by a viewer thereof. If the planar version is mounted on some part of the body the glowing dots or eyes seem to be peering out from inside the body of the wearer of the display novelty. Many other variations of the invention may be implemented using the teaching herein.

While what is described herein is the preferred embodiment of the invention it will be apparent to those skilled in the art that numerous changes may be made without departing from the spirit and scope of the invention. For example, the light source of the invention may be mounted on the underside of a brim of a hat, or may be mounted on top of the brim of the hat. Also, the invention may be mounted or attached to the top rim of eye glasses. The teaching of the invention may also be applied to a pendant worn from the neck with a necklace. The reflected light will appear to originate from within the wearer's body. In addition, the LED light sources and flat plastic piece(s) 15 could be mounted inside mask 11 against the inside surface thereof. Also, the LED light source(s) and flat plastic piece(s) 15 could be utilized with a pin or brooch on clothing or apart from clothing, or in any other manner.

The invention claimed is:

1. A display novelty device comprising:

a light source;

a mounting assembly mounting the light source on the head of a wearer so that light from the light source is focused downwardly in front of the wearer's face; and a transparent reflector supported by the mounting assembly and extending downwardly and outwardly in front of the wearer's face, the reflector having a rear surface nearest the wearer's face and a front surface furthest from the wearer's face, said reflector being operative for reflecting light from the light source from the front surface and away from the wearer's face to create an illusion to an observer of the display novelty device on the wearer's face that the light originated from the facial area of the wearer.

2. The display novelty device of claim 1 further comprising means for modifying the light emitted by the light source to change the visual appearance of the light reflected from the front surface of the transparent reflector away from the wearer's face.

3. The display novelty device of claim 2 wherein the means for modifying the light emitted by the light source comprises at least one light filter having an image thereon, and the light from the light source passes through the light filter and is thereby modified before being reflected from the front surface of the transparent reflector away from the wearer's face.

4. The display novelty device of claim 3 further comprising:

an electrical power source for providing power to light the light source; and means for connecting the power source to the light source.

5. The display novelty device of claim 4 wherein the wearer does not see the light from the light source when it is lit because it is reflected from the front surface of the transparent reflector and away from the wearer's face.

6. The display novelty device of claim 2 wherein the means for modifying the light emitted by the light source comprises means for modulating the intensity of the light from the light source.

7. The display novelty device of claim 6 further comprising:

an electrical power source for providing power to light the light source; and means for connecting the power source to the light source.

8. The display novelty device of claim 1 wherein the mounting assembly includes a face mask, hat, eye glasses or pendant.

9. The display novelty device of claim 1 further comprising:

an electrical power source for providing power to light the light source; and means for connecting the power source to the light source.

10. A novelty face mask to be worn on the face of a person, the face mask comprising:

(a) a face covering portion, the face covering portion having eye openings through which the person sees while wearing the face mask;

(b) a light source sending light downward in front of the eye openings; and (c) means for mounting the light source above the eye openings;

(d) means for reflecting the light from the light source away from the face mask, the reflecting means extending outward and downward in front of the eye openings, the reflecting means having a rear surface nearest the wearer's face and a front surface furthest from the wearer's face;

wherein when the light from the light source is reflected from the front surface of the reflecting means and away from the wearer's face to be seen by someone looking at the wearer of the face mask as light coming from the eye openings.

11. The novelty face mask of claim 10 further comprising:

means for modifying the light emitted by the light source to change the visual appearance of the light appearing to come from the two eye openings as seen by someone looking at the wearer of the face mask.

12. The novelty face mask of claim 11 wherein the means for modifying the light emitted by the light source comprises a light filter having an image thereon, and the light from the light sources passes through the light filter and is thereby modified before being reflected from the front surface of the reflecting means away from the wearer's face, so that someone looking at the wearer of the face mask sees the images on the light filters in the light appearing to come from the two eye openings.

13. The display novelty of claim 11 wherein the means for modifying the light emitted by the light source comprises means for modulating the intensity of the light from the light source.

14. The novelty face mask of claim 12 further comprising:

an electrical power source for providing power to light the light source; and means for connecting the power source to the light source.

15. The novelty face mask of claim 14 wherein the wearer of the novelty face mask does not see the light from the light source when it is lit and is reflected from the front surface of the reflecting means by the reflecting means.

16. The novelty face mask of claim 10 wherein the means for reflecting the light from the light source comprises a sheet of transparent material, the sheet having a top edge that is attached to the face mask above the eye openings, the sheet extending down and away from the mask to extend in front of the eye openings; wherein the person wearing the mask sees through the eye openings and the sheet of transparent material.

17. The novelty face mask of claim 16 further comprising:

an electrical power source for providing power to light the two light sources; and means for connecting the power source to the two light sources.

18. The novelty face mask of claim 17 wherein the mounting means includes a hat brim, protruding forehead or eye glasses that are part of the face mask.

19. The novelty face mask of claim 10 wherein the mounting means includes a hat brim, protruding forehead or eye glasses that are part of the face mask.

* * * * *